United States Patent [19]

Weil et al.

[11] Patent Number: 4,828,481

[45] Date of Patent: May 9, 1989

[54] PROCESS AND APPARATUS FOR HIGH TEMPERATURE COMBUSTION

[75] Inventors: Sanford A. Weil, Edwards, N.Y.; Tian-yu Xiong, Hinsdale; Donald K. Fleming, Park Ridge, both of Ill.

[73] Assignee: Institute of Gas Technology, Chicago, Ill.

[21] Appl. No.: 104,792

[22] Filed: Oct. 5, 1987

[51] Int. Cl.[4] ..... F23D 13/12

[52] U.S. Cl. ..... 431/7; 431/170; 431/328

[58] Field of Search ..... 431/7, 170, 328, 173; 110/237, 238

[56] References Cited

U.S. PATENT DOCUMENTS

| | | | |
|---|---|---|---|
| 2,552,845 | 5/1951 | Crosby | 431/328 |
| 2,828,813 | 4/1958 | Holden . | |
| 3,167,066 | 1/1965 | Hughes . | |
| 3,217,701 | 11/1965 | Weiss . | |
| 3,270,798 | 9/1966 | Ruff . | |
| 3,738,793 | 6/1973 | Reid et al. . | |
| 3,751,213 | 8/1973 | Sowards . | |
| 3,810,732 | 5/1974 | Koch . | |
| 3,912,443 | 10/1975 | Ravault et al. . | |
| 3,947,233 | 3/1976 | Sundberg | 431/328 |
| 4,087,962 | 5/1978 | Beremand et al. . | |
| 4,089,639 | 5/1978 | Reed et al. . | |
| 4,299,086 | 11/1981 | Madgavkar et al. . | |
| 4,311,447 | 1/1982 | Rackley et al. . | |
| 4,643,667 | 2/1987 | Fleming . | |

FOREIGN PATENT DOCUMENTS

| | | |
|---|---|---|
| 55-025773 | 8/1978 | Japan . |

*Primary Examiner*—James C. Yeung

*Attorney, Agent, or Firm*—Thomas W. Speckman

[57] ABSTRACT

A process and apparatus for high temperature combustion in a combustion chamber comprising two opposed porous plates is provided whereby increased combustion temperatures are achievable by means of internal radiant energy recuperation. The high temperature combustion apparatus and process may achieve superadiabatic combustion temperatures and is especially suitable for applications such as waste disposal and incineration.

20 Claims, 1 Drawing Sheet

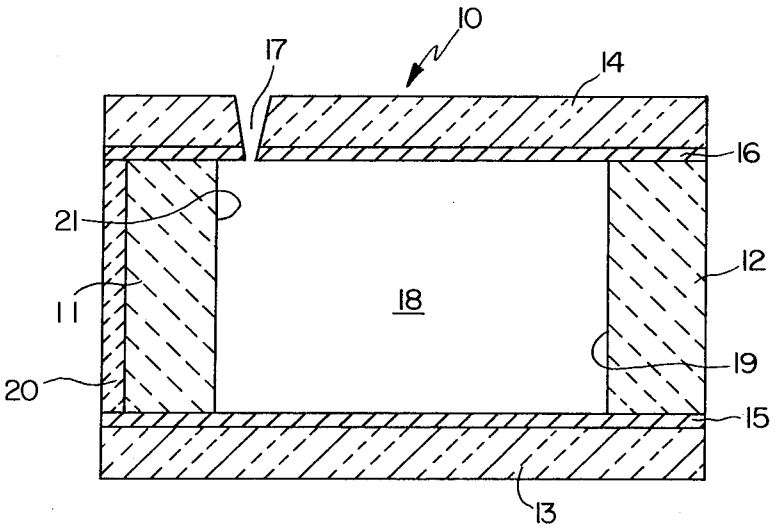
10
14
16
17
12
19
15
13
18
21
11
20

PROCESS AND APPARATUS FOR HIGH TEMPERATURE COMBUSTION

BACKGROUND OF THE INVENTION

1. Field of the Invention

The present invention relates to a process and apparatus for generating high combustion temperatures and providing increased process efficiency utilizing internal radiant energy recuperation. Combustion air is introduced into a combustion chamber through an inlet porous plate, and gaseous exhaust products are withdrawn through an opposing outlet porous plate to provide radiant energy recovery and radiant energy transfer across the combustion chamber. The high temperature combustion process and apparatus of the present invention may achieve super-adiabatic combustion temperatures and are especially suitable for use in applications such as incineration.

2. Description of the Prior Art

In general, heat transmission by radiation and utilization of infrared energy has many advantages over conventional means of heat transmission by convection and conduction, particularly for many industrial applications. The operation and construction of infrared burners and radiant heaters is relatively simple, and thus more economical than other types of heat generation means. The intensity of radiant heat may be precisely controlled to provide greater efficiency, and infrared energy may be-focused, reflected, or polarized, in accordance with the laws of optics. Conventional gas fired infrared burners utilize flame energy or hot gases to heat a radiating refractory or other material, and thereby produce an approximately flat flame on or above the radiating surface.

Several types of gas fired infrared generators are currently available. Radiant tube burners comprise internally fired radiation units wherein the radiating surface is interposed between the flame and the load. Surface combustion infrared burners have a radiating burner surface comprising a porous refractory. The combustion mixture is conveyed through the porous refractory and burns above the surface to heat the surface by conduction. A third type of gas fired infrared generator comprises a burner having a radiating refractory surface heated directly with a gas flame. A fourth type of infrared generator utilizes a porous catalyst bed to oxidize fuel at low temperatures in a low temperature catalytic burner.

U.S. Pat. No. 3,810,732 teaches non-catalyzed flameless combustion wherein a perforated, sintered block forms one wall of a mixing chamber. The '732 patent teaches that temperatures on the order of about 1000° C. to 2000° C. are attainable by passing combustible mixture through the perforated, sintered block at a low flow rate until a temperature of about 950° C. is reached, and then increasing the flow rate about ten to fifty times to cause combustion in the sintered block. The '732 patent also teaches a burner arrangement wherein two or three perforated sintered blocks are arranged parallel to one another and spaced apart, with combustion taking place in one of the blocks and radiating heat toward the adjacent block, thereby preheating the combustion air.

U.S. Pat. No. 3,217,701 teaches combustion at and within the surface of a porous fibrous refractory tube, with radiant energy and convection from exhaust gases directed to a secondary refractory surface to convert convection heat energy to radiant heat energy. U.S. Pat. No. 3,167,066 teaches radiant heating of fluids and gases by combustion in a perforated tubular section with solid refractory particles retained in an annular space surrounding the perforated tubular section and confined by a second, tubular radiating wall. U.S. Pat. No. 2,828,813 teaches a gas fired, porous wall furnace wherein passages are provided in the outer surface of the furnace wall to facilitate gas distribution and cooling. U.S. Pat. No. 4,087,962 teaches a direct heating surface combustor wherein spaced apart, flat plate burners form two walls of the combustion chamber with a radiant heat sink located between the plates. The '962 patent teaches low emission combustion and controlling of the combustion flame temperature to allow operation below adiabatic temperatures. U.S. Pat. No. 4,299,086 teaches combustion of a low heating value gas using less than a stoichiometric amount of oxygen in the presence of an oxygenation catalyst. U.S. Pat. No. 4,311,447 teaches a radiant surface combustor wherein a porous combustor element is in heat transfer relation with a heat transfer surface for absorbing radiant heat. U.S. Pat. No. 4,089,639 teaches premixing of water with fuel prior to burning to reduce-$NO_x$ formation.

Many different types and configurations of radiant gas burners are known to the art. U.S. Pat. No. 3,751,213 teaches a high intensity radiant gas burner having a ceramic honeycomb radiant element wherein combustion takes place within the cells of the honeycomb as well as in the combustion chamber. The material comprising the gas injection block, positioned downstream from the combustion chamber, is chosen on the basis of its density, taking into account the uniformity of gas flow, thermal insulating properties and durability of materials having various densities. Japanese Patent Publication No. 55025773 teaches an infrared burner having a honeycomb ceramic burner coated with an aqueous solution of magnesia-lithium silicate which is then fired to form a conductive layer. Combustion takes place at individual pores on the surface of the conductive layer, and the conductive layer promotes even heat distribution. U.S. Pat. No. 3,738,793 teaches an illumination burner having a layered porous structure, the layered pores maintaining a stable flame in a thoria-ceria illumination burner. Combustion does not occur within the pores of the combustor, but on the surface of the top layer. U.S. Pat. No. 3,912,443 teaches a layered ceramic radiant gas burner wherein the outer radiating layer comprises a coarsely porous ceramic material and an inner gas distributing layer comprises a finely porous, highly permeable ceramic material. U.S. Pat. No. 3,270,798 teaches a catalytic radiant burner having a lower density porous layer and a higher density porous layer, the lower density layer providing insulation and preventing flashback with flameless catalytic combustion occurring in the catalytic layers. U.S. Pat. No. 4,643,667 teaches a non-catalytic porous-phase combustor and process for generating radiant energy wherein the gas phase reaction and combustion take place within the pores of a multilayer porous plate having at least two discrete and contiguous layers, a first preheat layer comprising a material having a low inherent thermal conductivity and a second combustion layer comprising a material having a high inherent thermal conductivity and providing a radiating surface.

High temperature combustion, particularly for applications such as incineration, is an attractive industrial expedient to achieve better economics and greater waste destruction efficiencies. Combustion at high temperatures requires less time for equivalent waste conversion or, alternatively, permits greater waste conversion efficiencies in an equivalent combustor volume. Experimental approaches to achieve high temperature combustion for applications such as incineration have included techniques such as oxygen-rich firing of existing combustion apparatus, recuperative air preheat means, and thermochemical fuel modification. Each of these approaches requires more extensive equipment and/or more extensive investment in fuel required for combustion.

SUMMARY OF THE INVENTION

It is an object of the present invention to provide a process and apparatus for achieving high combustion temperatures for use in applications such as incineration of hazardous industrial waste products.

It is another object of the present invention to provide a process and apparatus for achieving superadiabatic combustion temperatures in a combustion chamber providing improved combustion efficiency by means of internal radiant energy recuperation.

It is yet another object of the present invention to provide an apparatus for high temperature combustion having a relatively simple construction, requiring minimal external equipment, and avoiding the use of more costly or specialized combustion fuels.

As the public environmental awareness level has increased, public dissatisfaction with the conventional practices of waste disposal has increased, and more efficient and immediate conversion of waste materials to innocuous forms is a preferred alternative. Disposal of hazardous and industrial chemical waste products and public acceptance of such disposal present serious public policy issues. The process and apparatus of the present invention are directed to high temperature combustion providing greater economic and destruction efficiency for use in applications such as incineration of hazardous and industrial chemical waste products.

According to the process and apparatus of the present invention, combustion air comprising oxygen is introduced into a combustion chamber through an inlet porous plate. Combustion air is mixed with combustible fuel and a transparent flame is generated in the combustion chamber. Gaseous exhaust products are withdrawn from the combustion chamber through an outlet porous plate aligned generally parallel to the inlet porous plate. Heat energy is radiated across the chamber from the inner radiating surface of the outlet plate to the inner surface of the inlet plate to heat the inlet plate, which facilitates preheating of the combustion air. A steady state system may be established wherein combustion air is preheated by heat transfer from the porous inlet plate, combustion occurs between the two opposed porous plates at temperatures greater than the normal adiabatic combustion temperature, and cooling of the gaseous exhaust products takes place in the outlet porous plate.

BRIEF DESCRIPTION OF THE DRAWING

Further features of the invention will be apparent from the following more detailed description taken in conjunction with the drawing which shows a highly schematic sectional view of a high temperature combustion chamber in accordance with one embodiment of the present invention.

DESCRIPTION OF PREFERRED EMBODIMENTS

As shown schematically in the drawing, combustor 10 comprises inlet porous plate 11 through which combustion air is introduced to combustion chamber 18 and outlet porous plate 12 through which exhaust gases are withdrawn from combustion chamber 18. Side walls 15 and 16 retain inlet plate 11 and outlet plate 12 in a generally parallel and spaced apart relationship and, along with insulating side walls 13 and 14, serve to reduce heat losses from combustion chamber 18. Additional layers of insulating materials may be provided as necessary to reduce heat losses from the combustion chamber. Suitable materials are well known to the art.

Combustor 10 may be provided in a variety of configurations, with a generally cylindrical, square or rectangular configuration being preferred for most applications. The ratio of length to diameter of combustion chamber 10 is preferably relatively low, from about 0.5 to about 2.0, and is preferably about 1.0.

Inlet plate 11 and outlet plate 12 may comprise a porous plate, a honeycomb plate, a firing tube burner, or loose particles of refractory material forming a stationary bed, where gravitational forces permit. Porous plates are preferred for most applications, and inlet and outlet porous plates preferably comprise refractory materials, such as zirconia, yttria-stabilized zirconia, silica, alumina, cordierite, magnesia, silicon carbide, silicon nitride, and the like which are capable of withstanding high combustion. temperatures of up to about 5000° F. Suitable types of porous plates have a porosity within the range of about 10 percent to about 90 percent, and preferably about 30 percent to about 50 percent, the pore sizes being relatively uniform and ranging from about 0.01 to about 0.10 inch in diameter, preferably from about 0.02 to about 0.05 inch in diameter. Inlet plate 11 and outlet plate 12 may be specially designed for particular applications, and, for example, inlet plate 11 may comprise a honeycomb plate while a porous plate is provided as outlet plate 12. Ground or crushed refractory material may be provided on the inner surface of inlet plate 11 and/or outlet plate 12 to provide a rough surface, thus increasing the emittance of the refractory plate. Both inlet plate 11 and outlet plate 12 preferably have a relatively high emissivity of from about 0.35 to about 1.0, and preferably from about 0.75 to about 0.90, and side walls 15 and 16 preferably have a relatively low emissivity, from about 0.10 to about 0.50, and preferably from about 0.25 to about 0.40. The emittance of porous or honeycomb plates having a relatively low emissivity may be increased by providing crushed or ground refractory chips on the surface, and plates having a high emittance are preferred for use in the practice of the present invention. Fritted refractory layer 20, comprising, for example, silicon carbide, may be disposed on the outer surface of inlet plate 11 to distribute the combustible mixture prior to introduction through inlet porous plate 11 into combustion chamber 18. Radiating surface 19 is on the inner surface of outlet-plate 12 facing combustion chamber 18 and receives heat energy from hot exhaust gases being withdrawn through outlet plate 12.

Combustible fuel may be introduced into combustion chamber 18 through combustible fuel inlet 17 in a side wall of the combustion chamber, or a portion of the combustion air may be mixed with combustible fuel and introduced through inlet 17 with the remaining combustion air being introduced through inlet plate 11. Alternatively, combustible fuel may be pre-mixed with combustion air and introduced into combustion chamber 18 through inlet plate 11. A plurality of combustible fuel inlets 17 may be provided in the side walls of combustion chamber 10. Combustible fuel inlets 17 preferably comprise high velocity tangential nozzles, whereby combustible fuel is injectable directly into combustion chamber 18 at a high velocity to provide good mixing of the combustible fuel with combustion air. Suitable types of combustible fuel include methane, propane, and other fuels that produce a transparent flame under high temperature conditions, and suitable combustible fuels are well known to the art. Suitable input pressures and velocities for combustion air and combustible fuel are known to the art and may be determined upon routine experimental investigation. A small amount of steam may be introduced into combustion chamber 18 along with the combustible fuel to insure transparent flame formation. Combustible fuel and combustion air are preferably injected into combustion chamber 18 in amounts sufficient to achieve a firing rate of about 1000 to about 5200 Btu/h-in$^2$, and most preferably to achieve a firing rate of about 1500 to about 3000 Btu/h-in$^2$.

Combustion air introduced through inlet plate 11 preferably comprises about 10 percent to about 60 percent oxygen, and most preferably comprises about 20.9 percent oxygen. Ambient air is preferred for use as combustion air in the practice of the present invention. The system is preferably operated using a substantially stoichiometric amount of oxygen, or slightly greater than the stoichiometric ratio of oxygen to combustible fuel, preferably from about 1 to about 1.8 times the stoichiometric amount of oxygen, and most preferably about 1.0 to about 1.2 times the stoichiometric amount of oxygen.

The high temperature combustion process and apparatus of the present invention is especially suitable for use in incineration of hazardous and industrial chemical waste products. According to a preferred embodiment, waste products are vaporized and introduced to combustion chamber 18 along with the combustible fuel and/or the combustion air. Due to the high temperatures attainable in combustion chamber 18, short residence times on the order of about 20 to about 500 milliseconds are generally suitable.

According to the process of the present invention, combustion air is introduced through inlet plate 11 to combustion chamber 18. Combustion takes place in combustion chamber 18 between outlet plate 12 and inlet plate 11. It is important in the practice of the present invention to maintain transparency across combustion chamber 18 at high combustion temperatures to achieve internal radiant recuperation, thereby achieving at least about 99 percent completion of the chemical reactions taking place: Internal radiant recuperation is provided by means of radiant surface 19 which is heated by heat transfer from hot exhaust gases withdrawn through outlet plate 12, and heat energy is radiated across combustion chamber 18 from radiant surface 19 to the inner surface 21 of inlet plate 11. According to the process of this invention, super-adiabatic combustion temperatures of up to about 5000° F. are obtainable in a suitably designed combustion chamber.

The following example sets forth specific embodiments of the present invention and methods of manufacture for the purpose of more fully understanding preferred embodiments of the present invention and is not intended to limit the invention in any way.

EXAMPLE

A combustion chamber of the type generally shown in the figure was constructed for experimental purposes. The combustor was cylindrical and the enclosed combustion chamber was 4 inches in diameter and 3 inches high. The inlet porous plate comprised two zirconia spinel honcycomb plates having dimensions of 4.07 inches in diameter and 0.5 inch thick, the honeycomb being a 16×16 square mesh with 70 percent open area. This porous plate provided a burner area of 12.57 square inches. The outlet porous plate comprised identical zirconia spinel honeycomb plates. The emissivity of the plates was assumed to be that of zirconia, which is about 0.35. The side walls of the chamber comprised high density, vacuum-formed zirconia cylinders, and additional insulating layers comprising zirconia, zirconia fiber, high purity alumina, and conventional alumina-silica blanket were provided.

Combustible fuel was pre-mixed with combustion air, and the combustible fuel-combustion air mixture was introduced through the inlet plate into the combustion zone. The combustible fuel comprised 96 percent $CH_4$ and 4 percent $C_2H_6$ having a heating value of approximately 989 Btu/ft$^2$ (at 60° F. and 29.92 inches Hg), and a specific weight of 0.741 kg/m$^3$. A silicon carbide frit was provided on the outer surface of the honeycomb input plate to distribute the combustible fuel/air mixture. The system was operated at a constant firing rate of 3150 Btu/h-in$^2$ in two modes, both with and without the outlet plate, to determine whether significantly higher combustion temperatures are achievable due to internal radiant recuperation provided by the outlet plate. The excess oxygen stoichiometric ratio was varied, and the adiabatic combustion temperature was calculated based upon the oxygen concentration in the combustion products, assuming complete combustion to carbon dioxide and water vapor, with no dissociation of the species. The experimental results are presented in Table 1.

TABLE 1

| Excess Oxygen Stoichiometric Ratio | Adiabatic Combustion Temperature (Calculated) | Combustion Temperature Measured without outlet plate | Combustion Temperature Measured with outlet plate |
|---|---|---|---|
| 1.3 | 3025 | 2940 | 3140 |
| 1.4 | 2880 | 2800 | 2970 |
| 1.5 | 2750 | 2670 | 2825 |
| 1.6 | 2620 | 2570 | 2700 |
| 1.7 | 2500 | 2450 | 2590 |
| 1.8 | 2390 | 2340 | 2470 |

The difference in temperature between the calculated adiabatic combustion temperature and the measured combustion temperature without the top plate is due to heat losses from the combustion chamber. The experimental data presented above clearly shows that internal radiant recuperation provides significantly higher combustion temperatures in the combustion chamber, and may achieve super-adiabatic combustion temperatures. The combustion temperatures of the experimental system were intentionally limited by maintaining the excess oxygen stoichiometric ratio above about 1.3 and by providing inlet and outlet plates having a relatively low emissivity. It is reasonable to expect increased internal radiant recuperation at lower excess oxygen stoichiometric ratios due to higher adiabatic combustion temperatures.

It will be obvious to those skilled in the art that various modifications may be made to the apparatus and process of the present invention without departing from the spirit and scope thereof, and that this invention is not intended to be limited to the embodiments shown in the drawing and described in the specification.

We claim:

1. A process for high temperature combustion comprising:

conveying combustion air through a porous inlet plate into an enclosed combustion chamber;

conveying a combustible fuel into said enclosed combustion chamber;

combusting said combustible fuel in said enclosed combustion chamber to produce exhaust gases;

withdrawing said exhaust gases from said enclosed combustion chamber through a porous outlet plate, thereby transferring thermal energy from said exhaust gases to said porous outlet plate; and radiating thermal energy from a radiant surface on the inner surface of said porous outlet plate facing said combustion chamber, said radiant surface having high emissivity relative to side walls of said enclosed combustion chamber, across said enclosed combustion chamber to said porous inlet plate, creating super-adiabatic temperatures within said enclosed combustion chamber.

2. A process for high temperature combustion according to claim 1 wherein said enclosed combustion chamber has a generally cylindrical shape, said combustion fuel is conveyed into said enclosed combustion chamber by injection through at least one high velocity tangential nozzle mounted approximately tangentially with respect to a combustion chamber wall.

3. A process for high temperature combustion according to claim 1 wherein said enclosed combustion chamber has a generally cylindrical shape, said combustible fuel is conveyed into said enclosed combustion chamber by injection through a plurality of high velocity tangential nozzles mounted approximately tangentially with respect to a combustion chamber wall.

4. A process for high temperature combustion according to claim 1 additionally comprising mixing said combustible fuel with said combustion air to form a combustible mixture prior to conveying said combustion air through said porous inlet plate, and conveying said combustible mixture through said porous inlet plate.

5. A process for high temperature combustion according to claim 1 wherein said combustion air and said combustible fuel are conveyed to said enclosed combustion chamber in amounts and at velocities sufficient to achieve a firing rate of about 1000 to about 5200 Btu/h-in$^2$.

6. A process for high temperature combustion according to claim 1 wherein said combustion air and said combustible fuel are conveyed to said enclosed combustion chamber in an amount sufficient to achieve a substantially. stoichiometric ratio of oxygen to combustible fuel.

7. A process for high temperature combustion according to claim 1 wherein said oxygen is present in an amount of about 1.0 to about 1.2 times the stoichiometric ratio of oxygen to combustible fuel.

8. A process for high temperature combustion according to claim 1 wherein said combustion air and said combustible fuel are conveyed to said enclosed combustion chamber in an amount sufficient to achieve a greater than stoichiometric ratio of oxygen to combustible fuel, said oxygen present in an excess amount of about 1.1 to about 1.8 times the stoichiometric amount.

9. A process for high temperature combustion according to claim 1 wherein said combustible fuel comprises primarily methane.

10. A process for high temperature combustion according to claim 1 wherein said combustion air and said combustible fuel is combusted in said enclosed combustion chamber at super-adiabatic combustion temperatures of more than about 70° F. higher than adiabatic combustion temperature.

11. A process for high temperature combustion according to claim 1 wherein said radiant surface of said porous outlet plate has an emissivity of about 0.35 to about 1.0 and said side walls have an emissivity of about 0.1 to about 0.50.

12. A process for high temperature combustion according to claim 1 wherein said radiant surface of said porous outlet plate has an emissivity of about 0.75 to about 0.90 and said said walls have an emissivity of about 0.25 to about 0.40.

13. A process for waste disposal by high temperature incineration comprising:

conveying combustion air through a porous inlet plate into an enclosed combustion chamber;

conveying a combustible fuel into said enclosed combustion chamber;

introducing waste materials into said enclosed combustion chamber;

substantially completing combusting said combustible fuel and said waste materials in said enclosed combustion chamber to produce exhaust gases;

withdrawing said exhaust gases from said enclosed combustion chamber and conveying said exhaust gases through a porous outlet plate, thereby transferring thermal energy from said exhaust gases to said porous outlet plate; and radiating thermal energy from a radiant surface on the inner surface of said porous outlet plate facing said combustion chamber, said radiant surface having high emissivity relative to side walls of said enclosed combustion chamber, across said enclosed combustion chamber to said porous inlet plate, creating super-adiabatic temperatures within said enclosed combustion chamber.

14. An apparatus for high temperature combustion comprising: a porous inlet plate, a porous outlet plate spaced from and aligned generally parallel to said porous inlet plate; refractory side walls maintaining said porous inlet plate spaced from and aligned with said porous outlet plate, and an enclosed combustion chamber defined by said porous inlet and outlet plates and said refractory side wall, said porous outlet plate having a radiant inner surface facing said combustion chamber having high emissivity relative to said refractory side walls.

15. An apparatus for high temperature combustion according to claim 14 wherein said porous inlet and outlet plates are generally round; said refractory side walls and said enclosed combustion chamber are generally cylindrical; and said enclosed combustion chamber has a length to diameter ratio of about 0.5:1.0 to about 2.0:1.0.

16. An apparatus for high temperature combustion according to claim 15 wherein said enclosed combustion chamber has a length to diameter ratio of about 1.0:1.0.

17. An apparatus for high temperature combustion according to claim 14 wherein said porous inlet and outlet plates have an emissivity of about 0.35 to about 1.0 and said refractory side walls have an emissivity of from about 0.10 to about 0.50.

18. An apparatus for high temperature combustion according to claim 17 wherein said porous inlet and outlet plates have an emissivity of about 0.75 to about 0.90 and said refractory side walls have an emissivity of about 0.25 to about 0.40.

19. A process for high temperature combustion comprising:

mixing a combustible fuel with combustion air to form a combustible mixture;

conveying said combustible mixture through a fritted refractory layer prior to conveying said combustible mixture through a porous inlet plate;

conveying said combustible mixture through said porous inlet plate into an enclosed combustion chamber;

combusting said combustible fuel in said enclosed combustion chamber to produce exhaust gases;

withdrawing said exhaust gases from said enclosed combustion chamber through a porous outlet plate, thereby transferring thermal energy from said exhaust gases to said porous outlet plate; and radiating thermal energy from a radiant surface of said porous outlet plate across said enclosed combustion chamber to said porous inlet plate thereby achieving super-adiabatic temperatures within said enclosed combustion chamber.

20. An apparatus for high temperature combustion comprising:

a porous inlet plate;

a fritted refractory layer aligned with and adjacent an exterior face of said porous inlet plate;

a porous outlet plate spaced from and aligned generally parallel to said porous inlet plate;

refractory side walls maintaining said porous inlet plate spaced from and aligned with said porous outlet plate; and an enclosed combustion chamber defined by said porous inlet and outlet plates and said refractory side walls.

* * * * *